United States Patent [19]

Madland

[11] 4,344,366

[45] Aug. 17, 1982

[54] RAILWAY CAR DOOR DRIVER

[75] Inventor: Thorvald Madland, Arlington Hts., Ill.

[73] Assignee: The Youngstown Steel Door Company, Cleveland, Ohio

[21] Appl. No.: 98,297

[22] Filed: Nov. 28, 1979

[51] Int. Cl.[3] ..... B61D 3/00; B61D 17/00; B61D 19/00; E05F 13/02

[52] U.S. Cl. ..... 105/378; 16/71; 49/235; 49/278

[58] Field of Search ..... 16/71, 99; 29/157.1 R, 29/434; 49/276, 277, 278, 235, 346; 105/378; 292/283, 284, 286

[56] References Cited

U.S. PATENT DOCUMENTS

| | | | |
|---|---|---|---|
| 1,428,785 | 9/1922 | Kuehner | 49/276 X |
| 1,471,159 | 1/1926 | Posson | 49/277 X |
| 1,474,584 | 11/1923 | Fahvenbruch | 292/284 |
| 1,489,648 | 4/1924 | Schmidt | 49/277 |
| 1,659,029 | 2/1928 | Julien | 49/277 |
| 1,748,257 | 2/1930 | Tobin | 49/277 |
| 1,768,170 | 6/1930 | Tobin et al. | 292/283 |
| 1,768,205 | 6/1930 | Lehnhoff et al. | 292/283 |
| 1,883,165 | 10/1932 | Vegren | 292/283 |
| 1,945,019 | 1/1934 | Busse | 49/277 |
| 1,950,837 | 3/1934 | Beauchamp | 292/283 |
| 1,955,423 | 4/1934 | Heinen | 49/277 X |
| 1,976,913 | 10/1934 | Beauchamp | 292/283 |
| 2,003,037 | 5/1935 | Chambers | 292/283 |
| 2,055,565 | 9/1936 | Vegren | 292/283 |
| 2,124,040 | 7/1938 | Olander | 49/235 |
| 2,177,325 | 10/1939 | Madland | 49/277 |
| 2,301,116 | 11/1942 | Gusbeth | 292/286 |
| 2,392,906 | 1/1946 | Doyle | 292/283 |
| 2,424,381 | 7/1947 | Beauchamp | 49/277 |
| 2,477,112 | 7/1949 | Beauchamp et al. | 49/277 |
| 2,478,688 | 8/1949 | Ditchfield | 292/284 |
| 2,483,611 | 10/1949 | Beauchamp et al. | 292/283 |
| 2,639,180 | 5/1953 | Nystrom | 292/283 |
| 2,772,901 | 12/1956 | Roethel | 49/346 X |
| 2,828,994 | 4/1958 | Noble | 292/283 |
| 2,866,634 | 12/1958 | Beauchamp | 49/278 |
| 3,279,839 | 10/1966 | Madland | 292/284 |
| 3,869,162 | 3/1975 | Schuller | 292/283 |
| 3,897,094 | 7/1975 | Schuller | 292/283 |
| 3,998,484 | 12/1976 | Wolak et al. | 292/283 |
| 4,038,734 | 8/1977 | Goldman | 29/157.1 R |
| 4,162,591 | 7/1979 | Madland et al. | 49/277 |

*Primary Examiner*—Joseph F. Peters, Jr.
*Assistant Examiner*—Howard Beltran
*Attorney, Agent, or Firm*—John H. Mulholland; Bruce M. Winchell

[57] ABSTRACT

A railway house car is provided with a sliding door and door driver. The door driver includes a lock having a door mounted hasp and upper and lower bracket portions mounted on a fixed door post for common engagement with a locking pin. The lower bracket portion has a pivoted manual lever mounted thereon with a crank arm for providing an increased mechanical advantage. The crank arm extends downwardly to pivotally and drivingly engage a door latch carried on an inner surface of the crank arm. The door latch has an opening on its end opposite the crank arm for selective connection to a flanged boss mounted on a vertical door edge reinforcement member. The lever with its crank arm and the door latch may be made from plate steel.

6 Claims, 7 Drawing Figures

RAILWAY CAR DOOR DRIVER

CROSS-REFERENCE TO RELATED APPLICATION

This application is an improvement of copending U.S. Patent Application Ser. No. 032,386, filed Apr. 23, 1979 by Thorvald Madland and assigned to the same assignee.

BACKGROUND OF THE INVENTION

The present invention relates to a door driver and more particularly to a door driver which effects movement of a railway house car door between a closed and locked position adjacent a door post and an open or sliding position.

When a railway car is in use, cargo is loaded into the railway car by opening the railway car door and moving the cargo to be transported into the car either manually or by mechanical means, such as a lift truck. Once the cargo is loaded into the railway car, the railway car door is closed, locked and sealed in that position. When the railway car reaches its destination, the railway car door is unsealed, unlocked and opened and the cargo is removed from the railway car. In some cases, the cargo is palletized and must necessarily be handled by lift trucks to reduce the labor for loading and unloading operations. Considerable damage may be caused to doors and the railway car side parts adjacent to the doorway in this way. If such damage has been caused, it is extremely difficult to open or close the door manually because of binding between the front stop on the railway car adjacent the door post and the leading edge of the railway car door. Lift trucks have been used to move the door into the locking position by exerting substantial force on the door. This operation, however, causes additional damage and corresponding door opening and closing difficulties.

Present door locking mechanisms have starters and closers that move the door out of or into the locking position over a small distance. One such prior art mechanism is disclosed in Madland U.S. Pat. No. 3,279,839. Madland discloses a lever which is capable of exerting a force on the railway car door through a locking hasp having an end opening, which urges the railway car door towards a locking position. This design, however, develops only a minimum mechanical advantage and very short door travel under optimum conditions. In most cases of deformation of car side parts or doors, this mechanical advantage is insufficient to move the door far enough and to overcome the binding forces with a force manually applied to the lever. Thus, the use of a lift truck or come-along device is required.

The door driver of U.S. Pat. No. 4,162,591 to Madland and Soddy utilizes a gear-driven crank member is association with a locking hasp having an end opening. The end opening is elongated to accommodate the arcuate path of a stud on the crank member. U.S. Patent Application Ser. No. 032,386, filed Apr. 23, 1979 and assigned to the same assignee by Madland eliminates the need for driving gears as required in U.S. Pat. No. 4,162,591 and provides a roller to minimize the counterproductive friction forces created by the stud while directing the driving forces normal to the opening defining cam surface.

SUMMARY OF THE INVENTION

The instant invention utilizes a locking and sealing means analogous to these prior art devices but incorporates a separate simple latch member which may be made from plate for direct drive of the door by means of a manual lever and crank functioning below the locking means. The lever and crank may also be made from plate.

The door driver includes a lock having a door mounted hasp and upper and lower bracket portions mounted on and in register with a fixed door post for common engagement with a locking pin. The lower bracket portion has the manual lever pivotally mounted thereon with a crank arm for providing an increased mechanical advantage. The crank arm extends downwardly to pivotally and drivingly engage the door latch which is carried on an inner surface of the crank arm. The door latch has an opening on its end opposite the crank arm for selective connection to a flanged boss mounted on a vertical door edge reinforcement member.

As is apparent from the above, the primary reason for using a door driver is to exert a force to move the door into and out of a locking or closed position, which force is sufficient to overcome binding forces between the railway car body or frame and the door. It is particularly desirable that this force is exerted by manual means and not by use of any auxiliary equipment which is expensive, time-consuming and, if not properly designed, may create additional damage to the door or railway car door frame. It is also desirable that the door driver be capable of moving the railway car door a substantial distance during opening and closing travel at a substantial mechanical advantage.

The door driver of the instant invention provides these advantages and further can be used on existing corrugated doors utilizing standard lock and support means. Furthermore, the invention eliminates the need for bushings and provides less friction in rotating the manual operating lever due to the minimization of eccentric loading of the shaft in the bearing. Also, the new lever and link of this invention can be fabricated from plate steel instead of special castings as required, for example, in Ser. No. 032,386, filed Apr. 23, 1979.

DETAILED DESCRIPTION OF THE INVENTION

Figure 1:
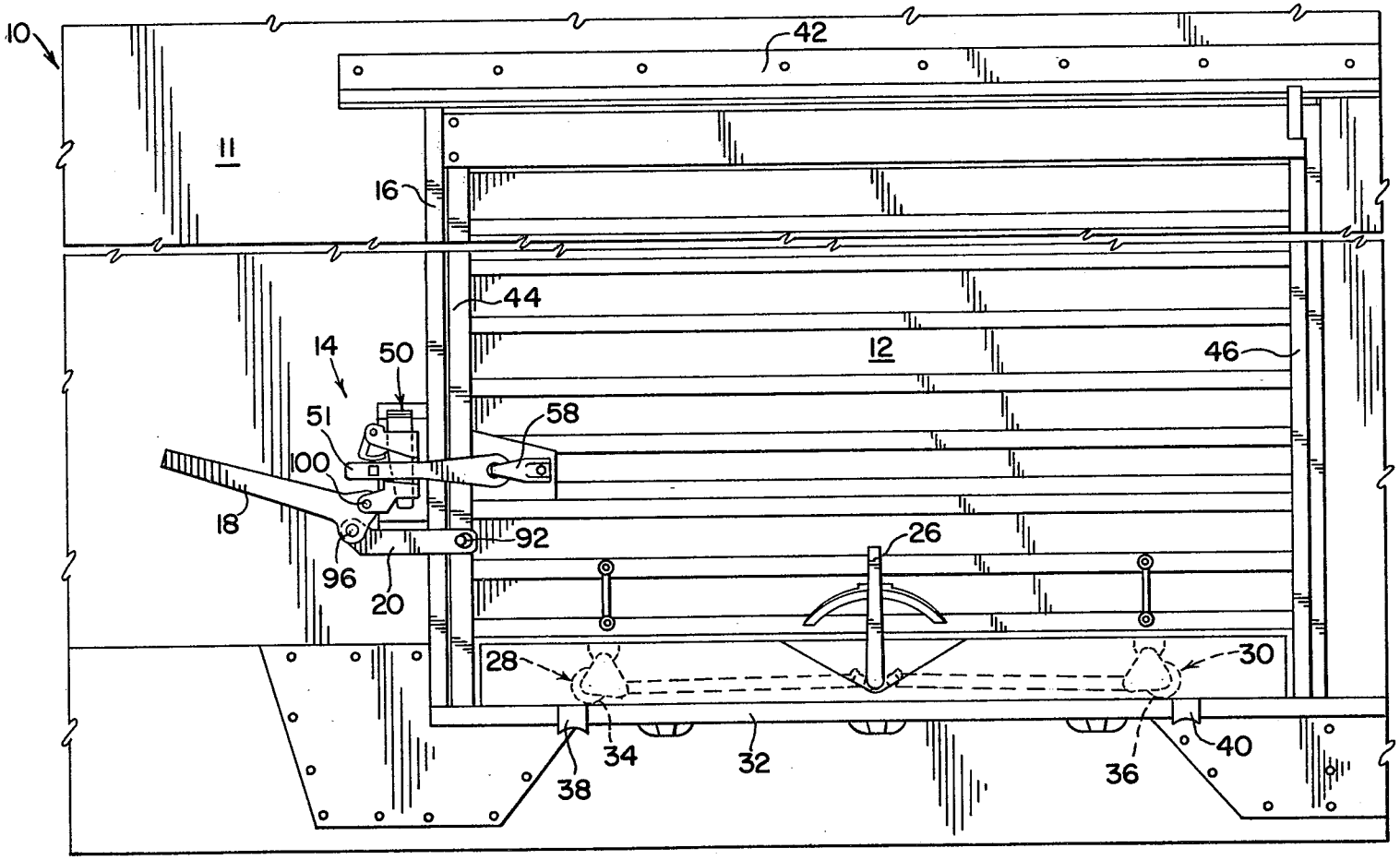
FIG. 1 is a front elevational view showing a door driver of the present invention applied to a single door construction of a railway car with the door in a closed or locked position.
Figure 2:
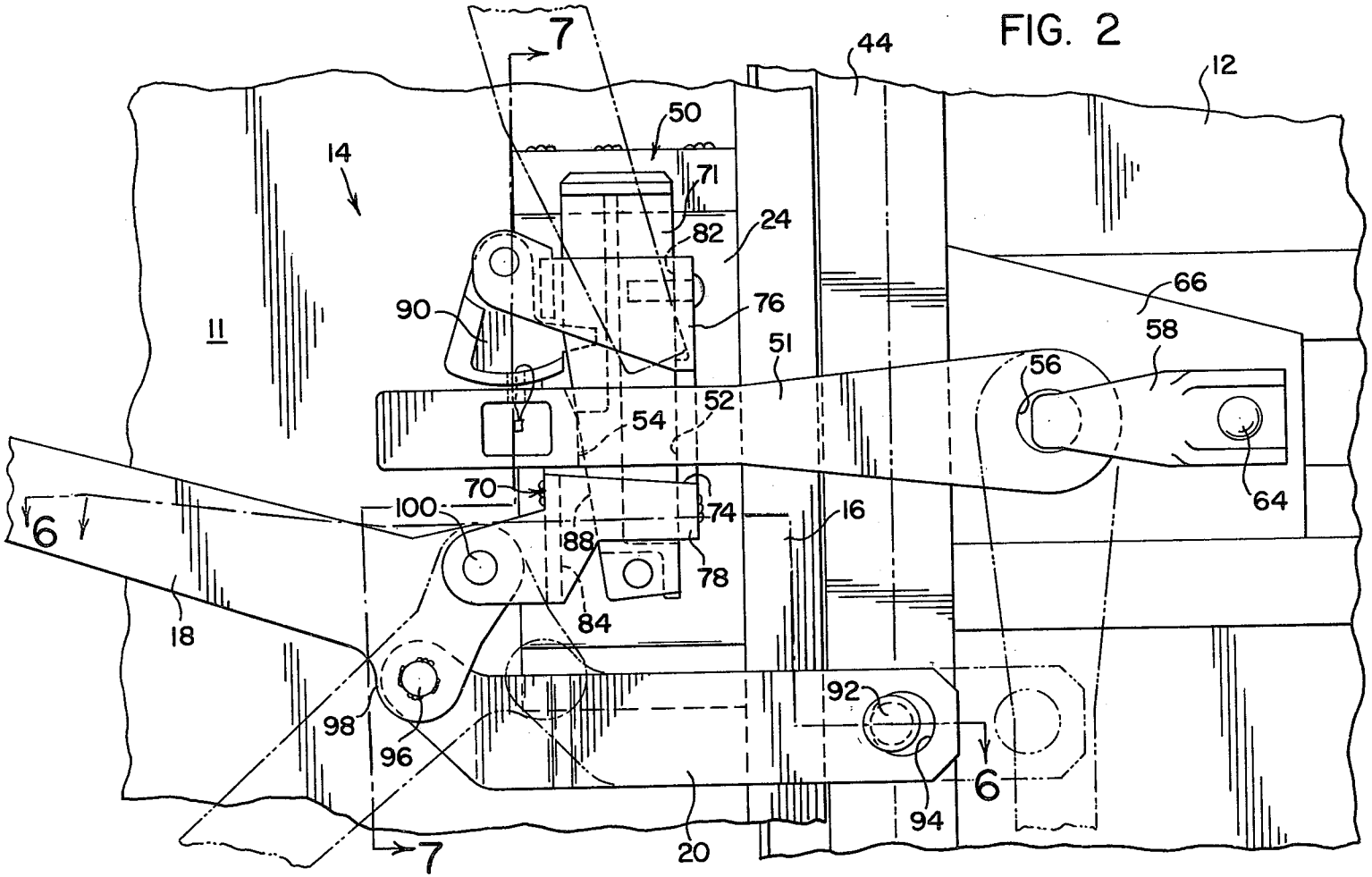
FIG. 2 is a detailed elevational view of the door driver shown in FIG. 1 with certain of the door driver elements shown in open and unlocked position in phantom.
Figure 3:
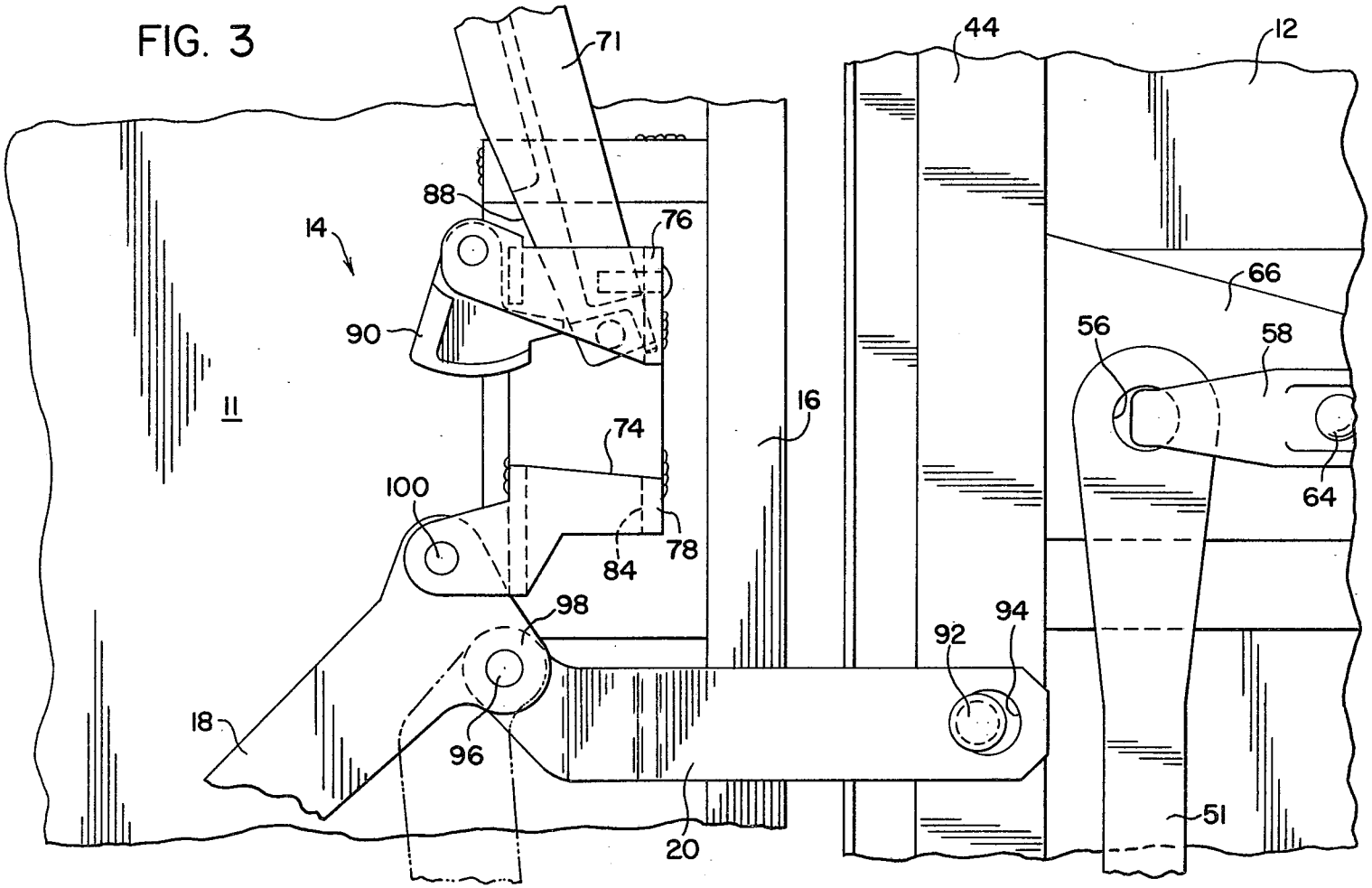
FIG. 3 is a detailed elevational view of the door driver of FIG. 1 with the railway car door in an unlocked and slightly opened position.
Figure 4:
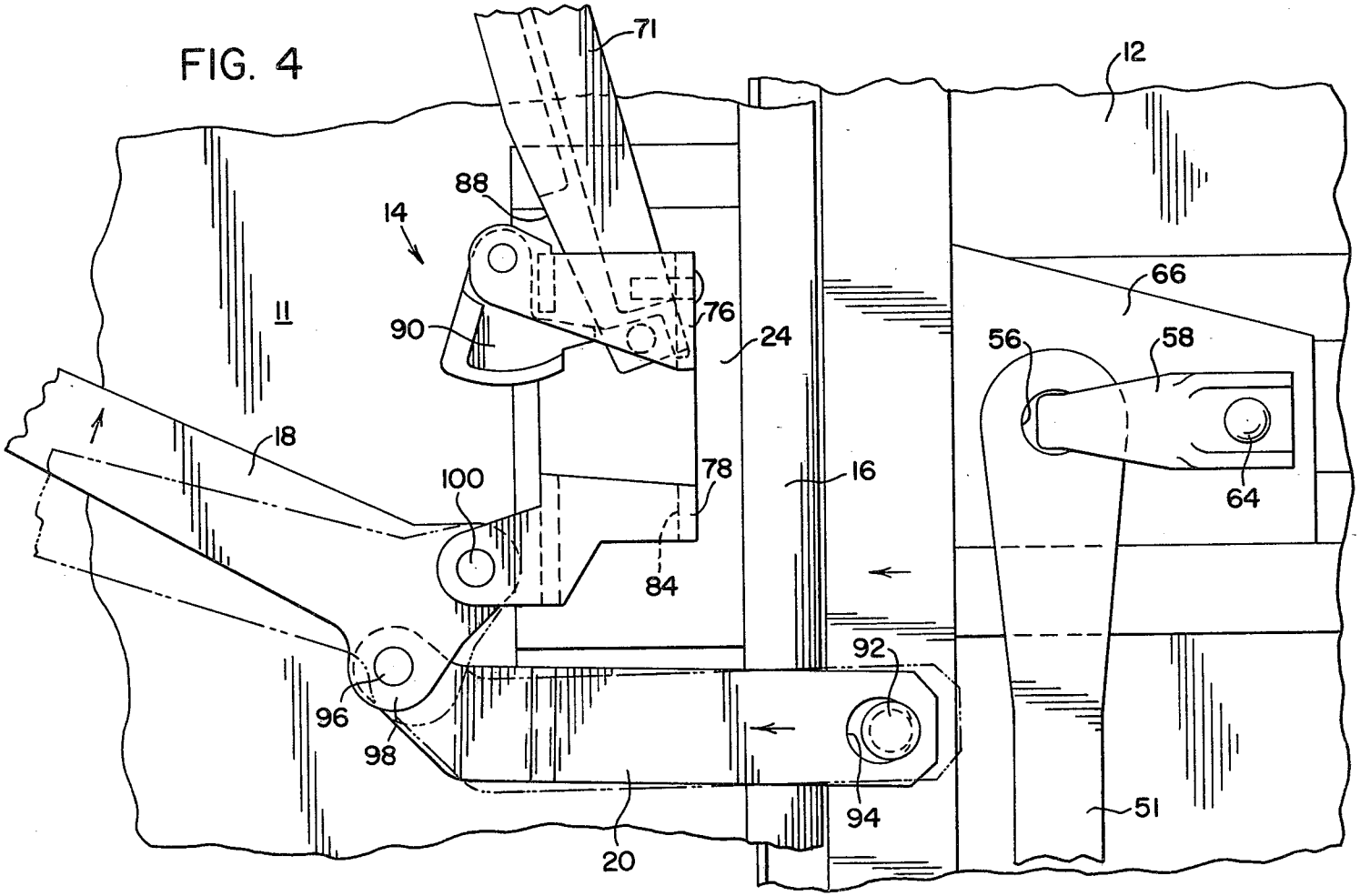
FIG. 4 is a detailed elevational view of the door driver shown in FIG. 1 with the door in a closed but unlocked position with a partially closed but not fully closed position in phantom.

In the drawings, a single door house car 10 is illustrated as having side sheathing 11 and a sliding door 12 with a novel door driver, generally designated by the numeral 14, as seen in FIG. 1. The railway car 10 has a door opening defining frame member or front stop 16. The door driver 14 of the present invention has a lever 18 and latch member 20 which may be selectively interconnected for moving the railway car door 12 between a closed position in which the door may be locked as seen in FIG. 2 and another position in which the door is unlocked and slightly opened as generally indicated in FIG. 3. In the unlocked and slightly opened position of FIG. 3 when the lever 18 and latch 20 are disengaged from the railway car door 12, the door 12 may be moved along the side of the railway car 10 to open the door opening completely so that cargo may be loaded into or unloaded from the railway car 10.

As described above, damage may occur to the door 12 during the loading and unloading process. Consequently, the door driver 14 is provided to urge the door 12 from the unlocked and slightly open position to the completely closed or locked position with a force sufficient to overcome any binding forces created by damaged portions of the door or other parts of the railway cars as will be hereinafter described.

The lever 18 of the door driver 14 is rotatably mounted for travel through an arc of seventy (70) degrees on a hat-shaped mounting member 24 mounted adjacent to the door opening as best seen in FIG. 2. The hat-shaped mounting member 24 is secured as, for example, by means of welding to the side sheathing 11 of the house car 10.

The door 12 is of the type generally known in the art as a lift door and includes a handle 26 and corresponding lifting mechanisms 28 and 30 which operate in a manner known to those skilled in the art. The lifting mechanisms 28 and 30 engage a track 32 for selective movement thereon by means of rollers 34 and 36 respectively. The general structure of the door 12 includes bottom retainers 38 and 40 in engagement with the track 32 and a top retainer structure 42 in cooperation with other conventional structural members to hold the door in aligned position for sliding movement upon actuation of the lift mechanism by the lever 26. The door 12 has a forward or leading edge or elongated vertical reinforcing member 44 and a rear edge or elongated reinforcing member 46.

Figure 6:
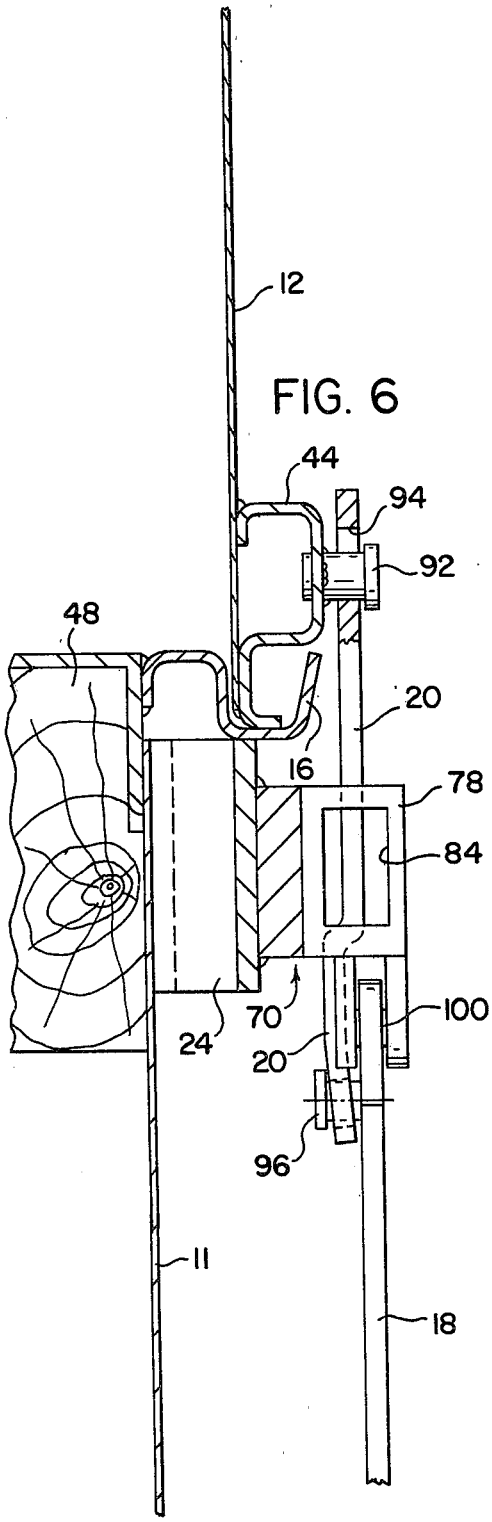
FIG. 6 is a cross-sectional view of the door driver shown in FIG. 2 taken along lines 6—6 thereof.
Figure 7:
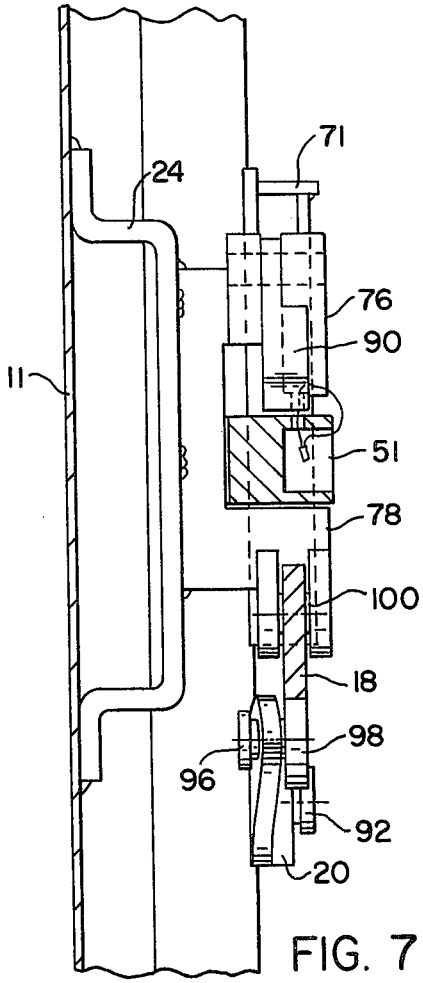
FIG. 7 is a cross-sectional view of the door driver shown in FIG. 2 taken along lines 7—7 thereof.

When the door is moved into a closed and locking position against front stop or door frame member 16, the rear edge 46 and the front edge 44 make a weathertight seal to close the door opening. The front stop 16 is mounted on a frontpost or fixed structure 48, as best seen in FIG. 6, in a manner well known to those skilled in the art.

The details of construction of the sliding door 12 and the surrounding structure as described are by way of environment and may be varied as will be readily recognized to those skilled in the art. As previously mentioned, for instance, the fixed structure including the front stop 16 may be functionally replaced by a second auxiliary door of a double door car. Accordingly, the door 12 represents either a single door or the main door of a double door car or of any other multiple car door.

A pin-type locking means, generally designated by the numeral 50, is provided to selectively lock and secure the door 12 in the closed position. A hasp 51 has a vertical opening 52 therethrough as best seen in FIG. 2. The vertical opening 52 has three substantially straight sidewall portions and forwardmost inner wall portion 54. The hasp 51 is pivotally mounted on the door 12 by means of a bore 56 in one end of the hasp which cooperates with a hasp fastener 58.

The hasp fastener 58 has a rivet or other conventional fastener 64 securing it to the panels of the door. Appropriate hasp fastener retaining plates and fillers 66 are interposed between the hasp fastener 58 and the surface of the door 12 to distribute the stresses and insure that the forces exerted on the hasp fastener by the hasp 51 will not damage the door 12 and pull the fastener from its seat.

The hasp 51 is of sufficient length that it projects from the end of the hasp fastener 58 past the forward edge 44 of the door 12 and past the front stop 16. The vertical hasp opening 52 is located at a point intermediate the ends of the hasp 51.

The locking means 50 is made up of two principal parts, a locking member 70 and a locking pin 71, as best seen in FIG. 2. The locking member 70 is mounted on the hat-shaped member 24 which is secured to the marginal portions of the sheathing 11. The locking member 70 has a generally channel-shaped slot 74 extending transversely across the locking member in a substantially horizontal direction to define an upper bracket portion 76 and a lower bracket portion 78. In the upper bracket portion 76 is a vertically oriented opening 82 and in the lower bracket portion 78 is a vertically oriented opening 84. The openings 82 and 84 are in substantially vertical alignment to provide a substantially vertical passage for receiving the locking pin 71.

The locking pin 71 is of such dimension as to permit its receipt in the openings 82 and 84 of the upper and lower brackets 76 and 78 respectively, and the channel 74 is adapted to receive the intermediate portion of the hasp 51 with its vertical opening 52 in substantial alignment with the openings 82 and 84. The hasp 51 is placed in this position by movement of the hasp laterally toward the locking member 70 through pivotal movement of the hasp on the hasp fastener. The surface 54 in the bore 62 of the hasp is adapted to cooperate with a tapered portion 88 on the pin 71 such that when the pin is in position and the vertical passage formed by the bores 82, 84 and 52, the pin 71 holds the hasp snuggly and firmly in place.

As seen in FIG. 2, a sealing cam 90 is received in a recess in pin 86 to positively prevent upward movement of the pin out of the locking position, and accordingly, it is required that sealing cam 90 be manually pivoted before the locking pin 71 may be lifted out of the openings 82, 84 to the point where the hasp 51 may be removed from the channel 74.

As will be seen, FIG. 3 shows the door in the unlocked and slightly opened position with a manually operated lever 18 in position to start the closing operation and with a latch 20 secured on a flanged boss or stud 92 which extends through an opening 94 on the end thereof. On the end of the latch 20, opposite the opening 94, is a pivot member 96 which pivotally and drivingly attaches the latch 20 to the inside surface of a crank arm portion 98 of the manual lever 18. The manual lever 18 is pivotally secured to the lower bracket portion 78 by pivot means or shaft 100 in such manner that there is a minimization of eccentric loading of the shaft 100 upon which it pivots. The latch 20, as well as the lever 18 with its crank arm portion 98, may be made from plate steel, the latch 20 having a bent intermediate portion to facilitate its pivotal connection to the shaft or pivot means 96 and its selective connection to the flanged boss or stud 92.

Figure 5:
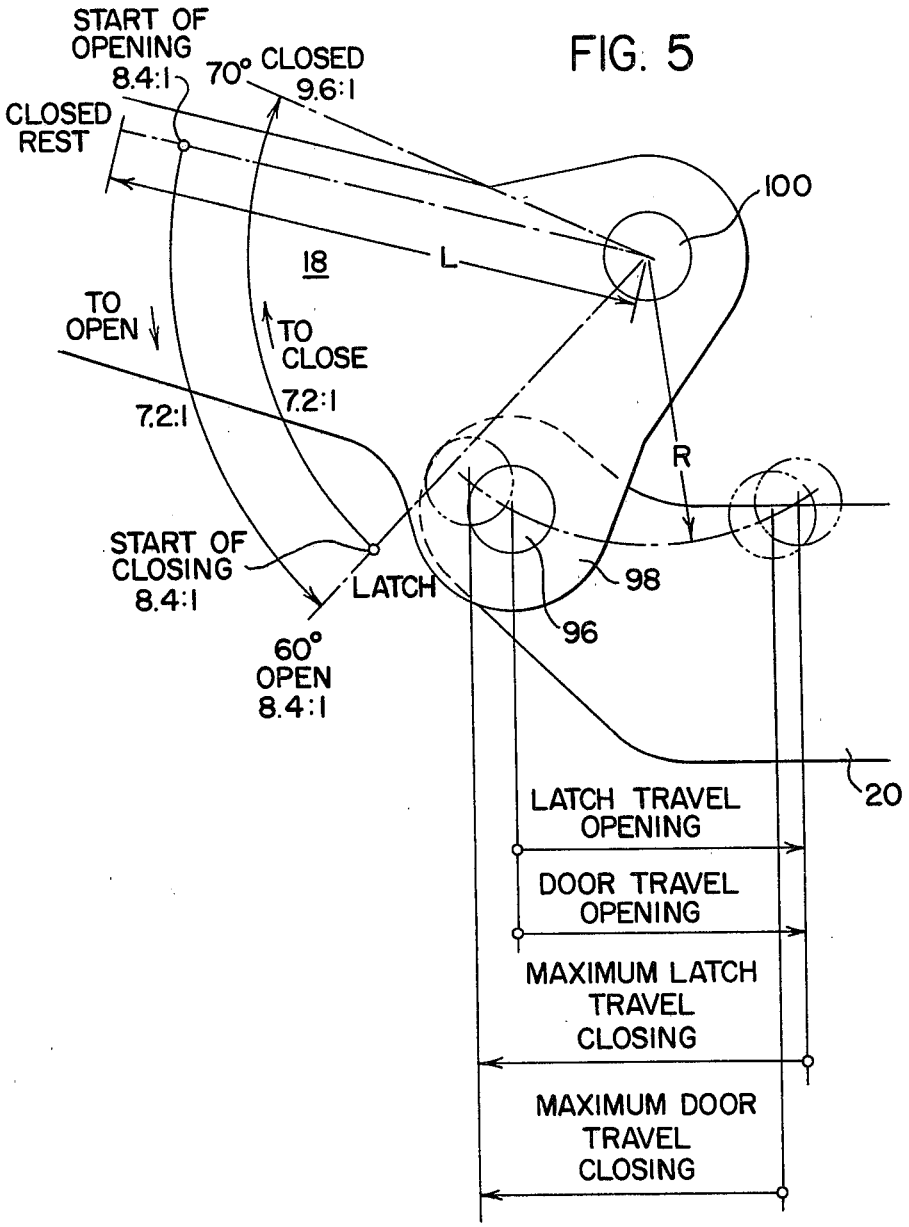
FIG. 5 is a schematic drawing of the various angular positions of the crank arm of the door driver with the door moving in different directions and at different positions to illustrate the different appropriate mechanical advantages obtained.

FIG. 5 illustrates the various positions of lever 18, its crank arm portion 98 and the latch 20 pivotally and drivingly connected thereto. It will be seen that as the lever moves from its position at the start of closing with a theoretical mechanical advantage, ignoring friction, of 8.4 to 1 it moves to a closed position through an arc in which its theoretical mechanical advantage, ignoring friction, is 7.2 to 1 to a final closed position seventy (70) degrees from the start wherein the theoretical mechanical advantage, ignoring friction, is 9.6 to 1. When the door is closed with the vertical reinforcing member 44 against the front stop 16, the lever 18 is in a closed rest position which is ten (10) degrees from its maximum point of travel during closing. At this point at the start of door opening, the lever 18 and its crank arm portion 98 develop a theoretical mechanical advantage, ignoring friction, of 8.4 to 1 and, as the lever moves downwardly through an arc of sixty (60) degrees to drive the door to the slightly open condition, the theoretical mechanical advantage, ignoring friction, is 7.2 to 1. At the full open position, the theoretical mechanical advantage, ignoring friction, is 8.4 to 1. The amount of latch travel opening, door travel opening and the maximum latch travel closing and the maximum door travel closing are also schematically illustrated in FIG. 5 for clarity. The manner of calculating these theoretical mechanical advantages is illustrated in the previously mentioned Madland application, Ser. No. 032,386, filed Apr. 23, 1979 and, accordingly, are not included herein.

Accordingly, the instant invention provides a compact door driver which can be used on existing corrugated doors utilizing a standard lock and support structure, this new arrangement nevertheless giving long door opening and closing travel while eliminating bushings and minimizing eccentric loading of the lever shaft and undue friction created thereby. All of this is provided in a lever and link structure utilizing castings from the previous prior art arrangements but with the lever and latch members being economically constructed of plate steel and not requiring new and expensive patterns such as would be the case if a cast structure and method of manufacture were required.

I claim:

1. A door driver in combination with a door lock for a railway house car door including:

a door lock hasp having a vertical opening therethrough mounted on the railway house car door, door lock upper and lower brackets mounted on a house car adjacent to the railway house car door having vertical openings therethrough to register with the vertical opening of said hasp, a locking pin for common engagement with said upper and lower brackets and said door lock hasp when the railway house car door is in a closed position and the vertical openings therethrough define a common substantially vertical passageway through which said locking pin extends to lock the door in a closed position, the improved door driver comprising:

a lever pivotally mounted at a point to the lower bracket of the door lock adjacent to the railway house car door such that with the railway house car door in a closed position, said lever is in a substantially horizontal position;

said lever having a crank arm extending therebelow to provide a mechanical advantage upon pivotal movement of said lever through a substantially acute angle; and an horizontal door latch member pivotally connectable to the railway house car door and to said lever at pivot points spaced below the pivot point of said lever for driving the railway house car door longitudinally upon counter-clockwise rotational movement of said lever between closed and partially open positions.

2. The door driver of claim 1 in which said upper bracket includes a locking cam for cooperation with said hasp member to seal said car.

3. The door driver of claim 1 in which the pivotal and driving engagement between said crank arm and said latch member are such that their respective pivotal components travel together in the same arcuate path during the final opening and initial closing movement of said door.

4. The door driver of claim 1 in which said latch member and said lever are plate steel.

5. The door driver of claim 1 in which said door latch member pivotal connection to said door is by means of a boss mounted on said door in register with said leading edge elongated vertical member of said door.

6. The door driver of claim 5 in which said boss is flanged and pivotal connection of said door latch member to said boss is by relative lateral movement of said flanged boss into an opening adjacent the end of said door latch opposite said crank arm.

* * * * *